US005938364A

United States Patent [19]

Hayden

[11] Patent Number: 5,938,364

[45] Date of Patent: Aug. 17, 1999

[54] STAGING SUPPORT

[75] Inventor: Michael R. Hayden, Edina, Minn.

[73] Assignee: Staging Concepts, Inc., Minneapolis, Minn.

[21] Appl. No.: 08/949,828

[22] Filed: Oct. 14, 1997

[51] Int. Cl.[6] ..... F16B 7/00

[52] U.S. Cl. ..... 403/171; 403/176; 403/217; 52/646

[58] Field of Search ..... 403/169, 170, 403/174, 178, 217, 218, 219, 171, 173, 176; 108/180, 153.1; 52/646, 648.1

[56] References Cited

U.S. PATENT DOCUMENTS

| | | | |
|---|---|---|---|
| 3,007,727 | 11/1961 | Ryan | 403/169 |
| 4,122,646 | 10/1978 | Sapp | 403/171 X |
| 4,242,969 | 1/1981 | Checkwood et al. | 403/170 X |
| 4,838,003 | 6/1989 | Zeigler . | |
| 4,904,108 | 2/1990 | Wendel | 403/173 |
| 4,971,090 | 11/1990 | Uhl | 403/170 X |
| 5,013,176 | 5/1991 | Orbom | 403/171 |
| 5,526,614 | 6/1996 | Huang | 403/170 X |

FOREIGN PATENT DOCUMENTS

| | | |
|---|---|---|
| 155618 | 12/1920 | United Kingdom . |

*Primary Examiner*—Harry C. Kim
*Attorney, Agent, or Firm*—Hugh D. Jaeger

[57] ABSTRACT

One-piece staging support for use in staging which can be horizontally collapsed. Cylindrical pivot supports are supported at a common level about a centrally located cylindrical body for the support of pivoted stage support members.

18 Claims, 9 Drawing Sheets

STAGING SUPPORT

CROSS REFERENCES TO CO-PENDING APPLICATIONS

None.

BACKGROUND OF THE INVENTION

1. Field of the Invention

The present invention pertains to a stage fixture and, more particularly, relates to a one-piece staging support for use in staging which can be horizontally collapsed.

2. Description of the Prior Art

Prior art collapsible staging incorporated pivotable horizontal members which allowed for collapsing of stage support members where horizontal component members were pivoted about vertical upright stage support members. Components of the ends of individual horizontal component members often were aligned at different levels over vertical upright stage support members and pivoted directly about the vertical upright stage support members without bearings or friction reducing devices.

Clearly what is needed is a staging support which can support a plurality of horizontal pivoted stage support members, such as box tubing and the like, at one level, and which also provides for friction reduction for deployment or collapsing of collapsible stage systems such as provided by the present invention.

SUMMARY OF THE INVENTION

The present invention is a one-piece staging support cast of aluminum or other suitable material. A centrally located cylindrical body is appropriately sized to fit over and align about an upright stage support member such as a tubular member. Extending from the cylindrical body and at the same level are a plurality of support struts upon which are located vertically aligned cylindrical pivot supports and a cylindrical cross member support. The cylindrical pivot supports include vertically aligned bores which accommodate pivot bolt assemblies which are incorporated to pivotally secure one end of pivoted stage support members to the staging support. The cylindrical cross member support includes a horizontally aligned bore which accommodates a bolt assembly which is incorporated to attach one end of a cross member support.

According to one embodiment of the present invention, there is provided a staging support. The staging support includes a cylindrical body having a central bore. Extending from the staging support and at the same level are opposing horizontally aligned support struts which support a left and a right cylindrical pivot support. Vertically aligned support struts align between the centrally located cylindrical body and each of the left and right cylindrical pivot supports and also intersect the horizontally aligned support struts. Also extending from the cylindrical body at the same level as the horizontally aligned support struts and oriented at a right angle to the horizontally and vertically oriented struts which support the left and right cylindrical pivot supports is a horizontally aligned support strut which supports a cylindrical cross member support. Vertically aligned support struts align between the centrally located cylindrical body and the cylindrical cross member support and intersect the horizontally aligned support strut which supports the cylindrical cross member support. Opposing body holes in the cylindrical body accommodate a bolt assembly which pins the staging support to an upright stage support member.

One significant aspect and feature of the present invention is a staging support which is one piece.

Another significant aspect and feature of the present invention is a staging support which includes cylindrical pivot supports and a cylindrical cross member support aligned to a cylindrical body at one level.

Yet another significant aspect and feature of the present invention is the incorporation of a friction reducing bushing in each cylindrical pivot support.

Still another significant aspect and feature of the present invention is the distant placement of cylindrical pivot supports and a cylindrical cross member support from the vertical center of an upright stage support member.

A further significant aspect and feature of the present invention is the incorporation of stops to aid and assist in alignment during deployment of a stage framework.

Having thus described one embodiment of the present invention, as well as significant aspects and features thereof, it is the principal object of the present invention to provide a staging support for use in staging assemblies which can be horizontally collapsed.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
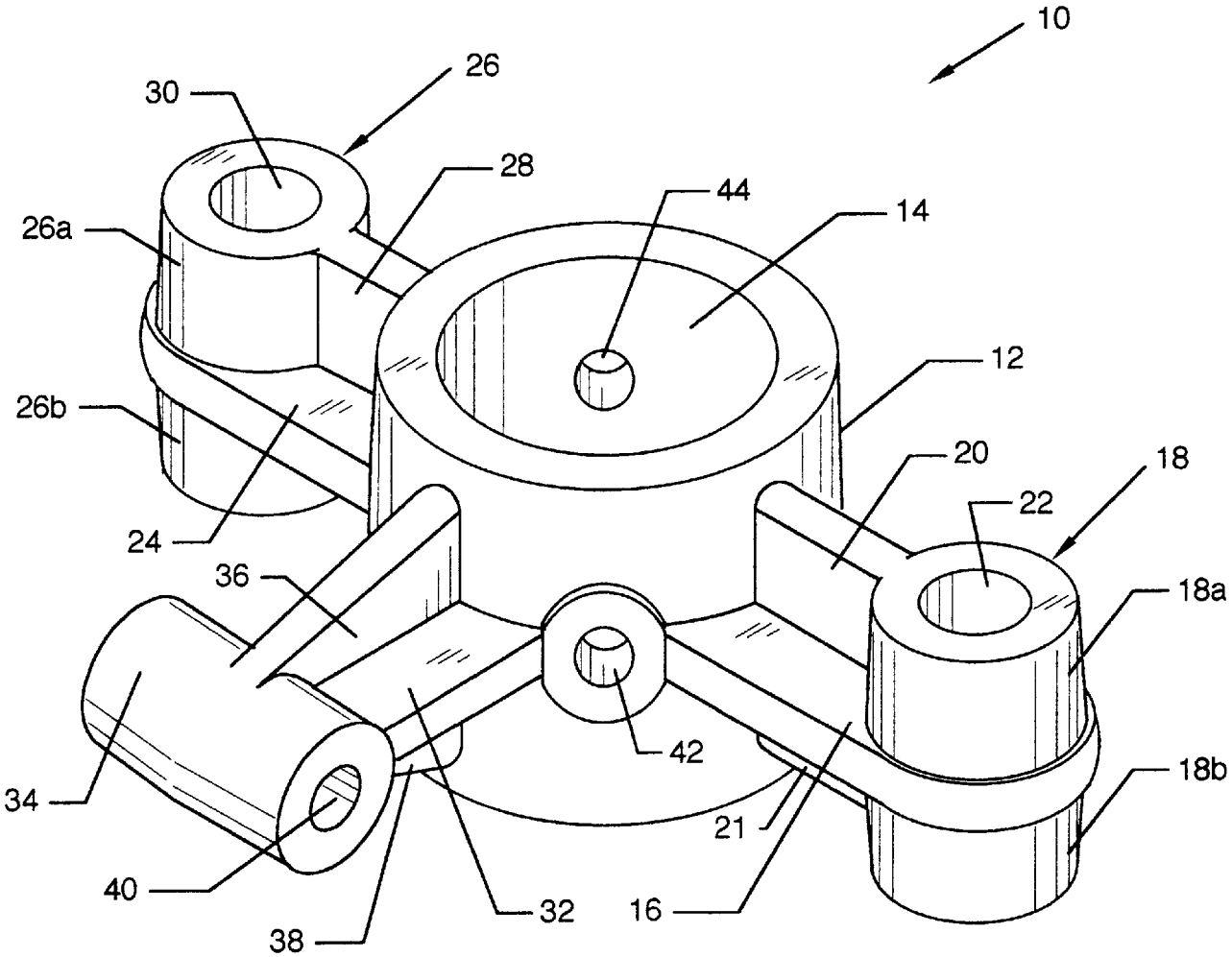
FIG. 1 illustrates an isometric view of a one-piece staging support, the present invention.

FIG. 1 illustrates an isometric view of a one-piece staging support 10, the present invention, which can be cast of aluminum or other suitable material or otherwise formed. Central to the staging support 10 is a cylindrical body 12 having a central bore 14. A horizontally aligned planar support strut 16 extends from the cylindrical body 12 to support a right vertically oriented cylindrical pivot support 18 which extends above and below the support strut 16. The right cylindrical pivot support 18 includes an upper cylindrical pivot support portion 18*a* and a lower cylindrical pivot support portion 18*b* extending from opposing surfaces of the planar support strut 16 as well as the portion located between the upper cylindrical pivot support portion 18*a* and the lower cylindrical pivot support portion 18*b* which adjoins the support strut 16. A vertically aligned upper support strut 20 extends between the upper region of the cylindrical body 12 and the upper cylindrical pivot support portion 18*a*. In a similar and mirror-like fashion, a vertically aligned lower support strut 21 (also illustrated in FIG. 3) extends between the lower region of the cylindrical body 12 and the lower cylindrical pivot support portion 18*b*. The right cylindrical pivot support 18 includes a vertically oriented bore 22 extending through the upper cylindrical pivot support portion 18*a*, through the portion located between the upper cylindrical pivot support portion 18*a* and the lower cylindrical pivot support portion 18*b* which adjoins the support strut 16, and through the lower cylindrical pivot support portion 18*b*. The right cylindrical pivot support 18 serves as a support for horizontal stage bracing, as later described in detail. A similarly fashioned structure opposes the horizontally aligned planar support strut 16, the vertically aligned upper and lower support struts 20 and 21, the right cylindrical pivot support 18, the vertically oriented bore 22 extending through the upper cylindrical pivot support portion 18*a*, through the portion between the upper cylindrical pivot support portion 18*a* and the lower cylindrical pivot support portion 18*b* which adjoins the support strut 16, and through the lower cylindrical pivot support portion 18*b*, and includes a horizontally aligned planar support strut 24, vertically aligned upper and lower support struts 28 and 29 (also illustrated in FIG. 3), a left vertically oriented cylindrical pivot support 26, and a vertically oriented bore 30 extending through the upper cylindrical pivot support portion 26*a*, through the portion between the upper cylindrical pivot support portion 26*a* and the lower cylindrical pivot support portion 26*b* which adjoins the support strut 24, and through the lower cylindrical pivot support portion 26*b*. Bores 22 and 30 accommodate pivoted stage support members, as later described in detail. Additionally, a horizontally aligned planar support strut 32 extends from the cylindrical body 12 and at a right angle to support struts 16 and 24 to support a horizontally oriented cylindrical cross member support 34. A vertically aligned upper support strut 36 extends between the upper region of the cylindrical body 12 and a portion of the upper circumference of the cylindrical cross member support 34. In the same fashion, a vertically aligned lower support strut 38 extends between the lower region of the cylindrical body 12 and a portion of the lower circumference of the cylindrical cross member support 34. A bore 40 is centrally located along the axis of the cylindrical cross member support 34 to accommodate attachment to a cross member. Horizontal body holes 42 and 44 oppose each other in the mid region of the cylindrical body 12 to accommodate a bolt assembly for the securing of the staging support 10 to an upright tubular stage support member, shown later in detail.

Figure 2:
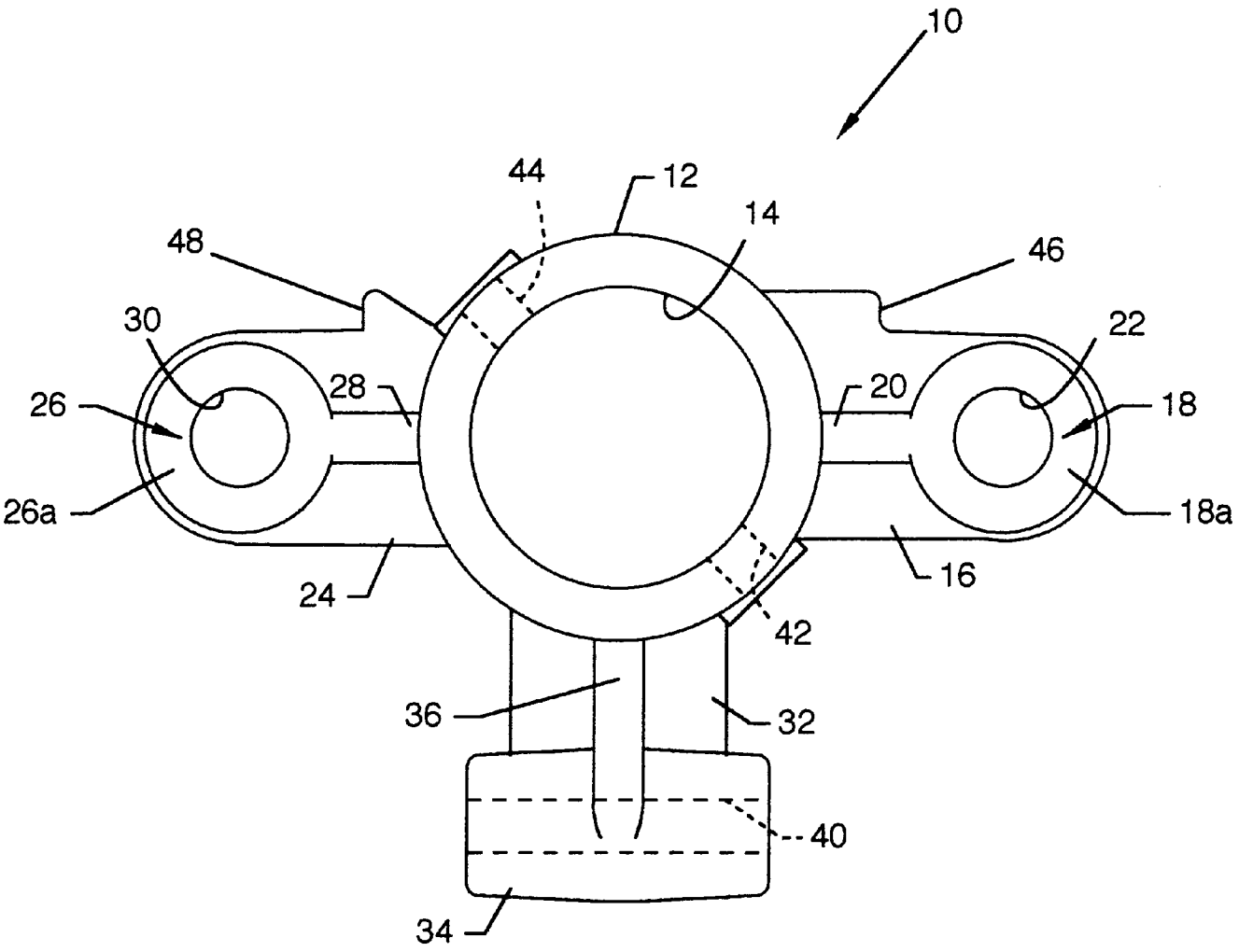
FIG. 2 illustrates a top view of the staging support.

FIG. 2 illustrates a top view of the staging support 10, where all numerals correspond to those elements previously described. Illustrated in particular is a stop 46 on the support strut 16 and a stop 48 on the support strut 24. Stops 46 and 48 prevent excessive rotational movement of horizontal stage bracing beyond the support struts 16 and 24 and assist in providing for proper alignment of pivoted stage support members.

Figure 3:
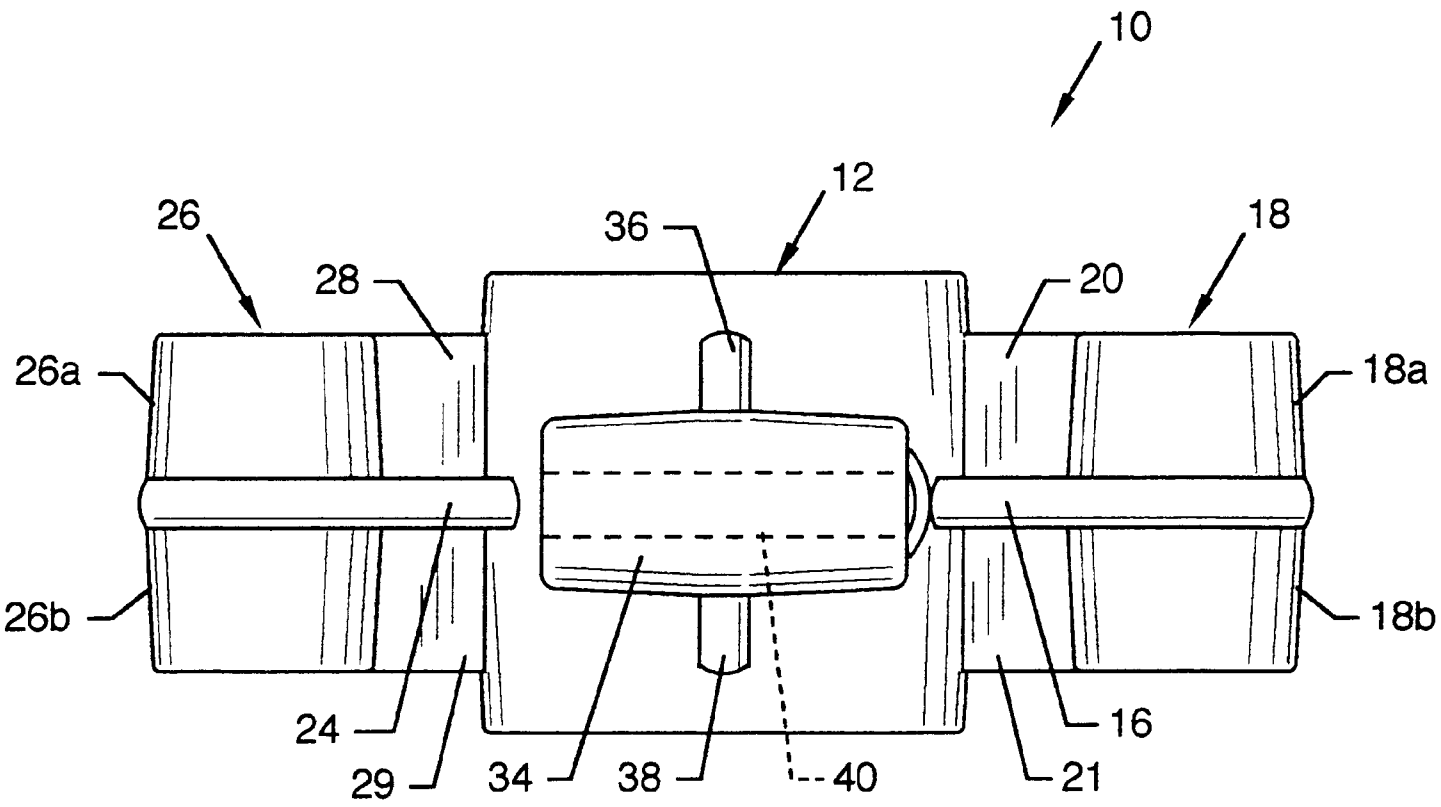
FIG. 3 illustrates a side view of the staging support.

FIG. 3 illustrates a side view of the staging support 10, where all numerals correspond to those elements previously described. Illustrated in particular are upper support struts 20, 28 and 36 and lower support struts 21, 29 and 38 which support right and left cylindrical pivot supports 18 and 26 and the cylindrical cross member support 34, respectively.

Figure 4:
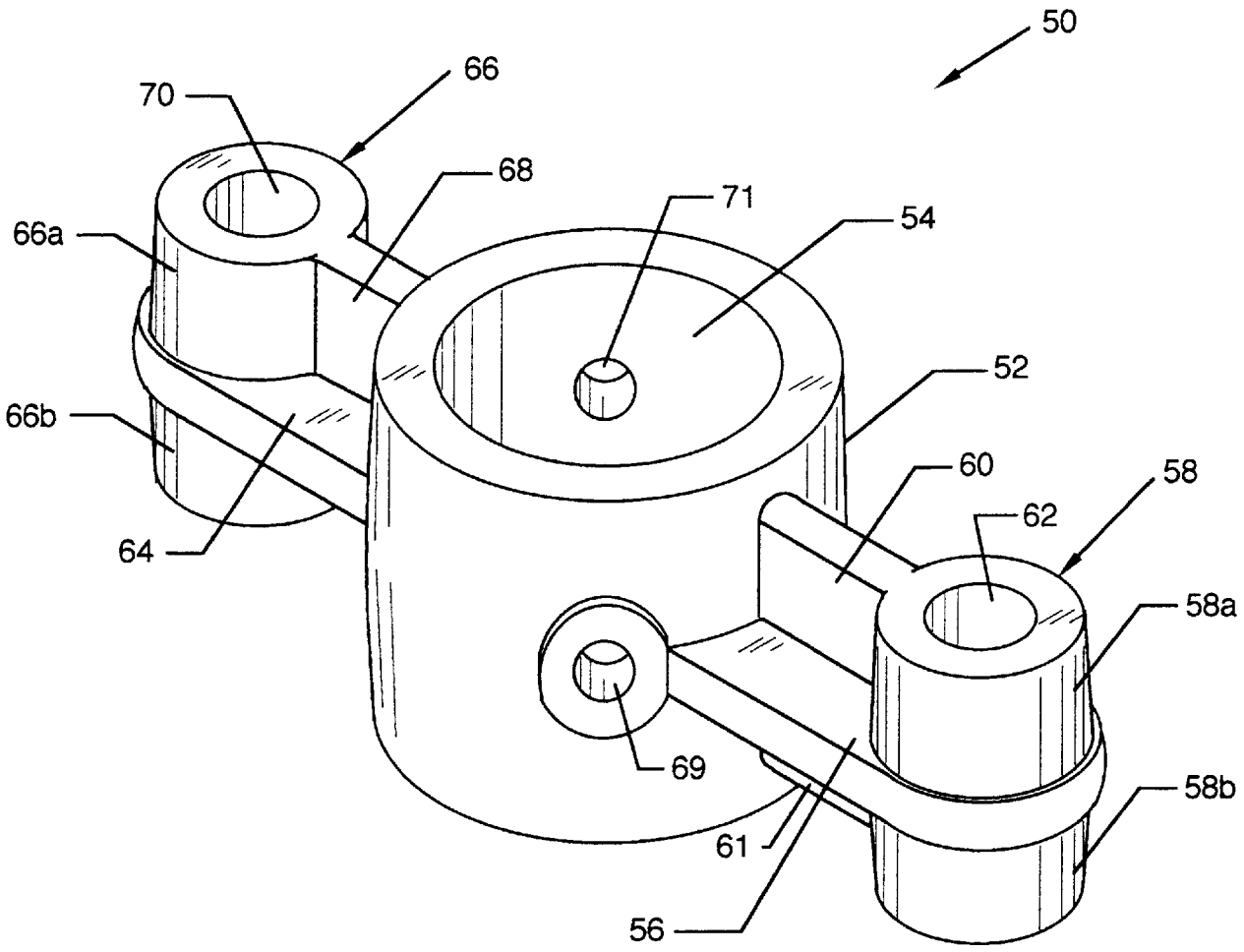
FIG. 4 illustrates an isometric view of an alternative staging support.

FIG. 4 illustrates an alternative one-piece staging support 50 having the same features as the one-piece staging support 10 but with the exclusion of the cylindrical cross member support 34, support strut 32, upper support strut 36, and lower support strut 38. FIG. 4 illustrates an isometric view of the one-piece staging support 50, an alternative of the present invention, which can be cast of aluminum or other suitable material or otherwise formed. Central to the alternative staging support 50 is a cylindrical body 52 having a central bore 54. A horizontally aligned planar support strut 56 extends from the cylindrical body 52 to support a right vertically oriented cylindrical pivot support 58 which extends above and below the support strut 56. The right cylindrical pivot support 58 includes an upper cylindrical pivot support portion 58*a* and a lower cylindrical pivot support portion 58*b* extending from opposing surfaces of the planar support strut 56 as well as the portion located between the upper cylindrical pivot support portion 58*a* and the lower cylindrical pivot support portion 58*b* which adjoins the support strut 56. A vertically aligned upper support strut 60 extends between the upper region of the cylindrical body 52 and the upper cylindrical pivot support portion 58*a*. In a similar and mirror-like fashion, a vertically aligned lower support strut 61 extends between the lower region of the cylindrical body 52 and the lower cylindrical pivot support portion 58*b*. The right cylindrical pivot support 58 includes a vertically oriented bore 62 extending through the upper cylindrical pivot support portion 58*a*, through the portion located between the upper cylindrical pivot support portion 58*a* and the lower cylindrical pivot support portion 58*b* which adjoins the support strut 56, and through the lower cylindrical pivot support portion 58*b*. The right cylindrical pivot support 58 serves as a support for horizontal stage bracing, as later described in detail. A similarly fashioned structure opposes the horizontally aligned planar support strut 56, the vertically aligned upper support strut 60, the vertically aligned lower support strut 61, the right cylindrical pivot support 58, the vertically oriented bore 62 extending through the upper cylindrical pivot support portion 58*a*, through the portion between the upper cylindrical pivot support portion 58*a* and the lower cylindrical pivot support portion 58*b* which adjoins the support strut 56, and through the lower cylindrical pivot support portion 58*b*, and includes a horizontally aligned planar support strut 64, a vertically aligned upper support strut 68 and a corresponding lower support strut (not illustrated), a left vertically oriented cylindrical pivot support 66, and a vertically oriented bore 70 extending through the upper cylindrical pivot support portion 66*a*, through the portion between the upper cylindrical pivot support portion 66*a* and the lower cylindrical pivot support portion 66*b* which adjoins the support strut 64, and through the lower cylindrical pivot support portion 66*b*. Bores 62 and 70 accommodate pivoted stage support members, as later described in detail. Body holes 69 and 71 oppose each other in the mid region of the cylindrical body 52 to accommodate a bolt assembly for the securing of the alternative staging support 50 to an upright tubular stage support member in a manner and fashion similar to that shown in FIG. 5.

Figure 5:
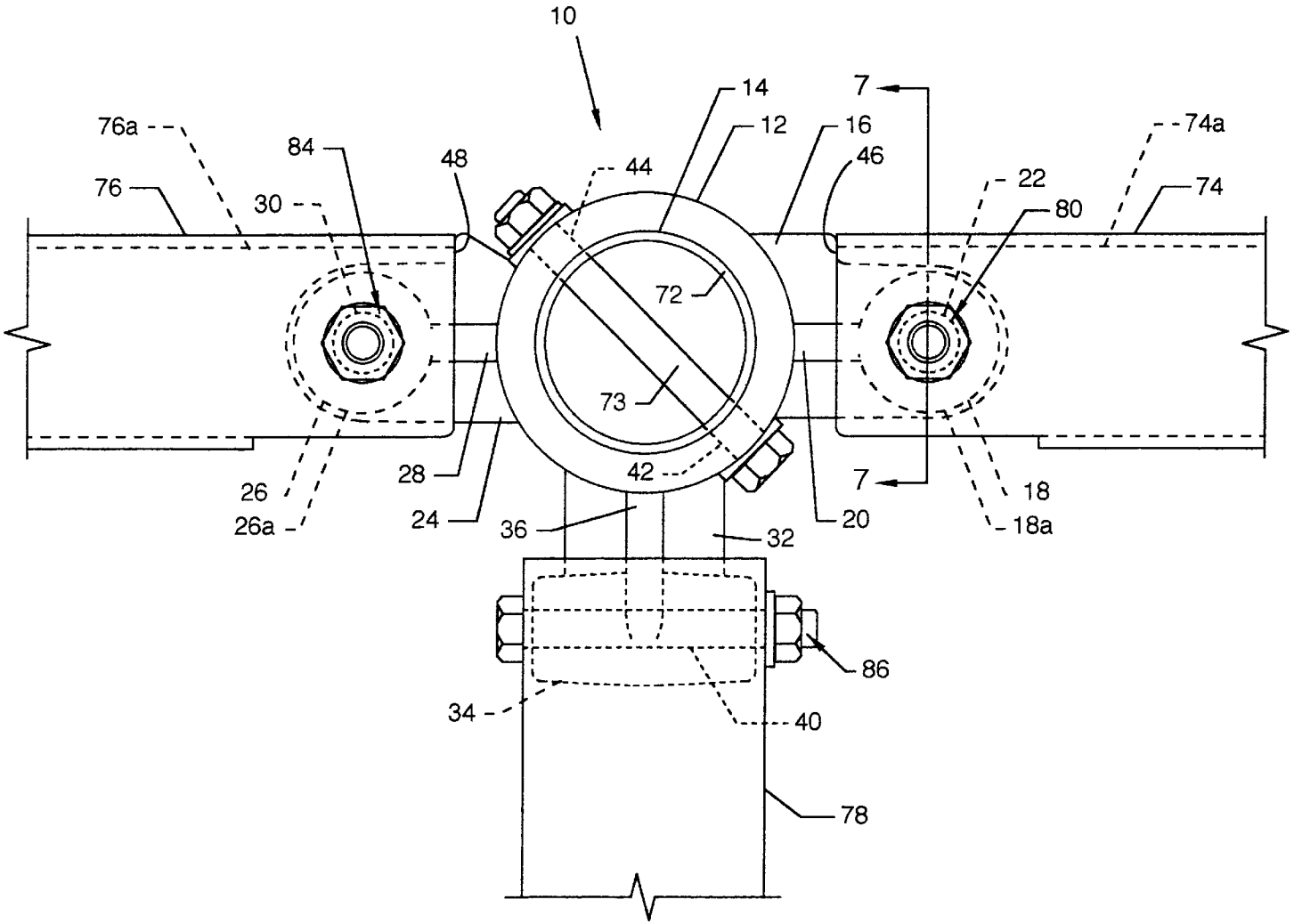
FIG. 5 illustrates a top view of the staging support in association with stage support members and a cross member support.

FIG. 5 illustrates a top view of the staging support 10, the present invention, secured to an upright tubular stage support member 72, where all numerals correspond to those elements previously described. A bolt assembly 73 passes through body holes 42 and 44 in the cylindrical body 12 and also through appropriately spaced holes in the upright tubular stage support member 72. Also included in the top view are right and left pivoted stage support members 74 and 76, respectively, and a cross member support 78 secured to the staging support 10. A pivot bolt assembly 80 extends through orifices in the upper and lower surfaces of the right pivoted stage support member 74 and through a bushing 82 (illustrated in FIG. 7) centrally located in the bore 22 in the right cylindrical pivot support 18. A pivot bolt assembly 84 extends through orifices in the upper and lower surfaces of the left pivoted stage support member 76 and through a bushing similar to bushing 82, described and illustrated in FIG. 7, centrally located in the bore 30 in the left cylindrical pivot support 26. It can be seen that further rotation of the right pivoted stage support member 74 in a counterclockwise direction about the pivot bolt assembly 80 is prevented by impingement of a vertical surface 74*a* of the right pivoted stage support member 74 against stop 46 located on support strut 16, and further rotation of the left pivoted stage support member 76 in a clockwise direction about the pivot bolt assembly 84 is prevented by impingement of a vertical surface 76*a* of the left pivoted stage support member 76 against stop 48 located on support strut 24. Right and left pivoted stage support members 74 and 76 are in direct alignment with each other at opposing sides of the staging support 10 when the right and left pivoted stage support members 74 and 76 are deployed, positioned and poised for acceptance of staging platforms. When the framework for staging is deployed, the stops 46 and 48 assist in final alignment to keep the framework oriented at right angles to the direction of deployment and from deviation from the desired final deployment path. The stops 46 and 48 prevent the right and left pivoted stage support members 74 and 76 from going across center, thus providing for deploymental stability. Cross member support 78 secures to the cylindrical cross member support 34 by a bolt assembly 86 passing through orifices in the vertical sides of the cross member support 78 and through the bore 40 of the cylindrical cross member support 34. An overall view of a plurality of staging supports 10 and a plurality of alternative staging supports 50 and a plurality of attached right and left pivoted stage support members 74, 74A, 76 and 76A and cross member supports 78 in the deployed position for acceptance of staging platforms is shown in FIG. 8.

Figure 6:
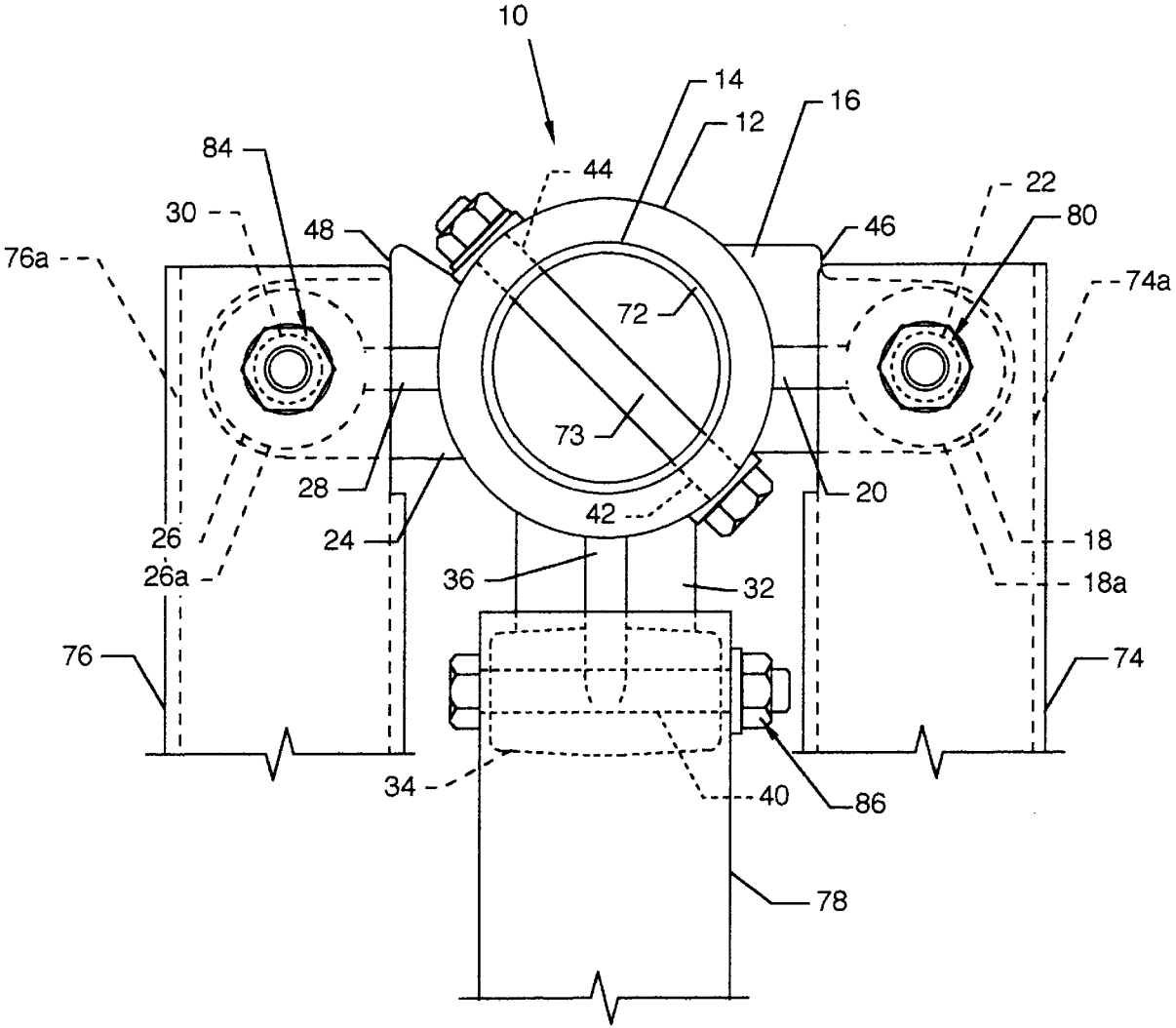
FIG. 6 illustrates a top view of the staging support and members shown in FIG. 5, where the right pivoted stage support member and the left pivoted stage support member have been pivoted into parallel alignment.

FIG. 6 illustrates a top view of the staging support 10 shown in FIG. 5, where the right pivoted stage support member 74 and the left pivoted stage support member 76 have been pivoted into parallel alignment with the cross member support 78, where all numerals correspond to those elements previously described. An overall view of pluralities of staging supports 10 and 50 and a plurality of attached right and left pivoted stage support members 74 and 76 in mutual parallel alignment with each other and in parallel alignment with cross member supports 78 is shown in FIG. 9.

Figure 7:
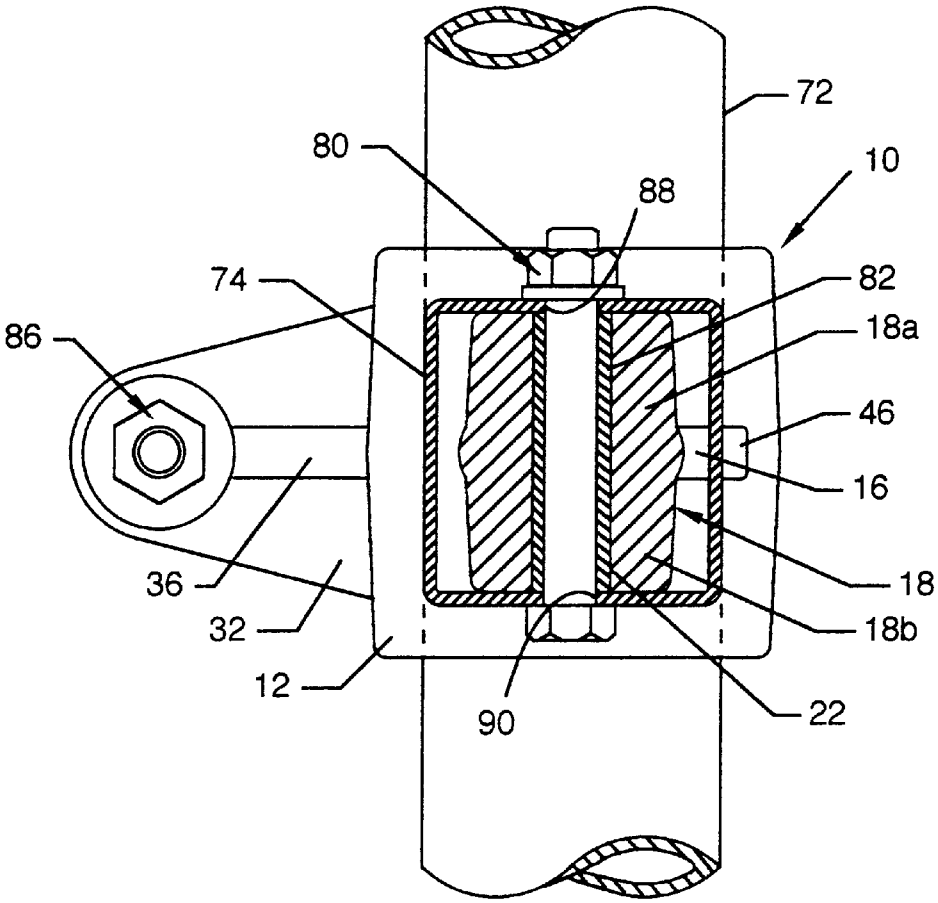
FIG. 7 illustrates a cross sectional view along line 7—7 of FIG. 5; and, FIGS. 8 and 9 illustrate the use of a plurality of staging supports and alternative staging supports with a plurality of pivoted stage support members.
Figure 8:
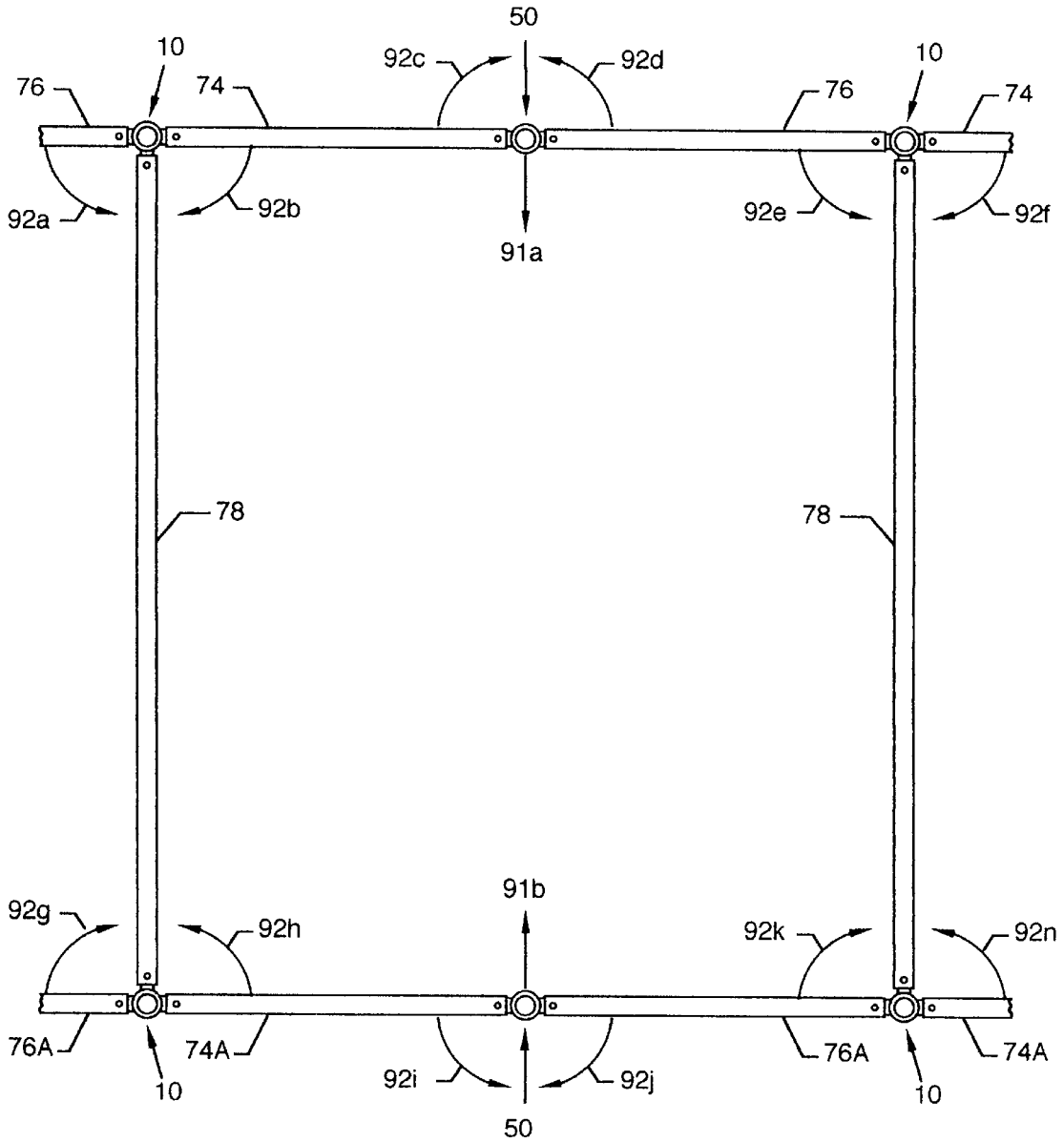

FIG. 7 illustrates a cross sectional view along line 7—7 of FIG. 5, where all numerals correspond to those elements previously described. Illustrated in particular is the attachment of the right pivoted stage support member 74 to the right cylindrical pivot support 18. A bushing 82 aligns in the bore 22 of the right cylindrical pivot support 18. Pivot bolt assembly 80 aligns in the bushing 82 and through holes 88 and 90 in the right pivoted stage support member 74. Attachment of the left pivoted stage support member 76 to the left cylindrical pivot support 26 is accomplished in the same manner and fashion, but is not illustrated for the purpose of brevity and clarity.

MODE OF OPERATION

Figure 9:
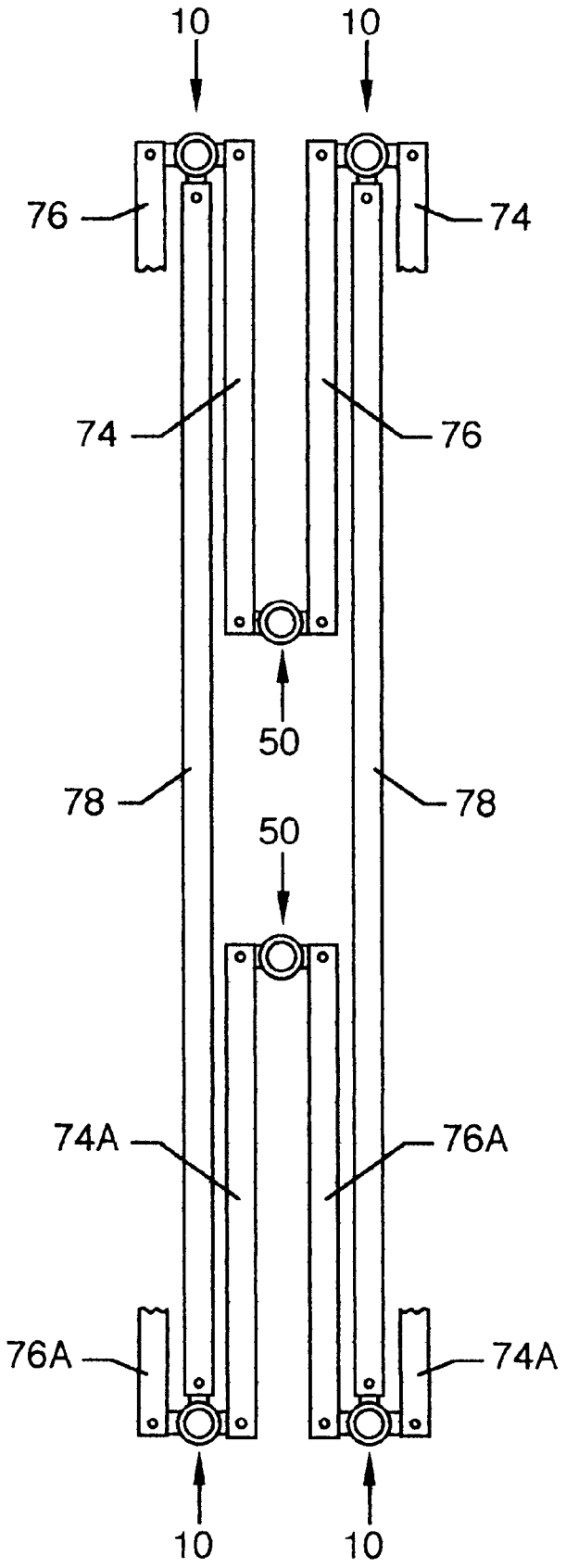

FIGS. 8 and 9 illustrate the use of a plurality of staging supports 10 and a plurality of alternative staging supports 50 with a plurality of pivoted stage support members. FIG. 8 illustrates the use of a plurality of right and left pivoted stage support members 74 and 76 in mutual straight line alignment, or overcenter locking, across the staging supports 10 and alternative staging support 50 illustrated at the top of the figure. Correspondingly, a plurality of right and left pivoted stage support members 74A and 76A, being constructed in a fashion similar to the right and left pivoted stage support members 74 and 76, are in mutual straight line alignment, or overcenter locking, across the staging supports 10 and alternative staging support 50 illustrated at the bottom of the figure. The entire assembly illustrated in FIG. 8 can be folded inwardly to a present a low silhouette profile by first positioning the alternative staging supports 50 inwardly as indicated by arrows 91*a* and 91*b* to overcome over center locking and to allow pivoting of the right and left pivoted stage support members 74, 74A, 76 and 76A about the respective staging supports 10 and alternative staging supports 50, as shown by a plurality of arrows 92*a*–92*n*, and by subsequently applying pressure on either of the left or right cross member supports 78 to form a compact position, as illustrated in FIG. 9.

Various modifications can be made to the present invention without departing from the apparent scope hereof.

I claim:

1. A staging support for a horizontal collapsible staging system, comprising:

a. a central body having a substantially cylindrical outer surface and a circular central bore;

b. a first pivot support having a substantially cylindrical outer surface and a circular central bore;

c. a first strut extending from said outer surface of said first pivot support and connecting said first pivot support to said outer surface of said central body at a first location;

d. a second pivot support having a substantially cylindrical outer surface and a circular central bore;

e. a second strut extending from said outer surface of said second pivot support and connecting said second pivot support to said outer surface of said cental body at a second location, said second location being spaced 180 degrees from said first location;

f. said first strut being in alignment with said second strut;

g. said circular central bores of said central body, said first pivot support, and said second pivot support each having a longitudinal axis, said longitudinal axes being parallel to each other and lying in the same plane; and, h. said central body having two holes extending therethrough from said outer surface of said central body to said circular central bore of said central body, said two holes being spaced 180 degrees apart and being in alignment with each other.

2. The staging support as defined in claim 1, and wherein said central body, said first and second pivot supports, and said first and second struts are all formed as an integral, one-piece construction.

3. The staging support as defined in claim 1, and wherein said central body, said first and second pivot supports, and said first and second struts are formed in one unitary piece out of metal.

4. The staging support as defined in claim 1, and wherein, said two holes in said central body are located approximately at the mid point of said central body.

5. The staging support as defined in claim 1, and wherein said second pivot support and said second strut are mirror images of said first pivot support and said first strut.

6. The staging support as defined in claim 1, and wherein said first strut and said second strut are each cruciform-shaped.

7. The staging support as defined in claim 1, and wherein said first strut and said second strut have equal lengths, and wherein said first pivot support and said second pivot support are the same size.

8. The staging support as defined in claim 1, and wherein each of said circular central bores of said first and second pivot supports contains a friction reducing bushing.

9. The staging support as defined in claim 1, and further comprising:

a. a cross member support having a substantially cylindrical outer surface and a circular central bore having a longitudinal axis;

b. a third strut extending from said outer surface of said cross member support and connecting said cross member support to said outer surface of said central body at a third location positioned midway between said first location and said second location; and, c. said longitudinal axis of said circular central bore of said cross member support extending transverse to said longitudinal axes of said circular central bores of said central body and said first and second pivot supports and lying in a plane parallel to said plane containing said longitudinal axes of said circular central bores of said central body and said first and second pivot supports.

10. The staging support as defined in claim 9, and wherein said central body, said first and second pivot supports, said cross member support, and said first, second and third struts are all formed as an integral, one-piece construction.

11. The staging support as defined in claim 9, and wherein said third strut is positioned at the same level on said outer surface of said central body as said aligned first and second struts.

12. The staging support as defined in claim 9, and wherein said two holes and said first, second and third struts are all located approximately at the mid point of said central body.

13. The staging support as defined in claim 9, and wherein said third strut is cruciform-shaped.

14. The staging support as defined in claim 9, and wherein said first and second struts have equal lengths, and wherein said first pivot support and said second pivot support are the same size.

15. The staging support as defined in claim 9, and wherein each of said first and second struts includes a stop for preventing excessive rotational movement of horizontal stage bracing and for assisting in providing proper alignment of pivoted stage support members.

16. The staging support as defined in claim 15, and wherein each of said first and second struts has substantially the shape of a Greek cross having an upright shaft and a transverse shaft substantially equal in length and intersecting perpendicularly to each other substantially at their middles, said upright shafts each extending in the same direction as said longitudinal axes of said circular central bores of said central body and said first and second pivot supports, and wherein said stops protrude from said transverse shafts in the direction opposite to the direction in which said third strut extends from said outer surface of said central body.

17. A unitary, one-piece, metallic staging support for a horizontal collapsible staging system, comprising:

a. a central body having a substantially cylindrical outer surface and a circular central bore;

b. a first pivot support having a substantially cylindrical outer surface and a circular central bore;

c. a first cruciform-shaped strut extending from said outer surface of said first pivot support and connecting said first pivot support to said outer surface of said central body at a first location;

d. a second pivot support having a substantially cylindrical outer surface and a circular central bore;

e. a second cruciform-shaped strut extending from said outer surface of said second pivot support and connecting said second pivot support to said outer surface of said cental body at a second location, said second location being spaced 180 degrees from said first location;

f. said first strut and said second strut being equal in length, said first pivot support and said second pivot support being the same size, and said first strut being aligned with said second strut;

g. said circular central bores of said central body, said first pivot support, and said second pivot support each having a longitudinal axis, said longitudinal axes being parallel to each other and lying in the same plane; and, h. said central body having two holes extending therethrough from said outer surface of said central body to said circular central bore of said central body, said two holes being spaced 180 degrees apart and being in alignment with each other.

18. A unitary, one-piece, metallic staging support for a horizontal collapsible staging system, comprising:

a. a central body having a substantially cylindrical outer surface and a circular central bore having a longitudinal axis;

b. a first pivot support having a substantially cylindrical outer surface and a circular central bore having a longitudinal axis;

c. a first cruciform-shaped strut extending from said outer surface of said first pivot support and connecting said first pivot support to said outer surface of said central body at a first location;

d. a second pivot support having a substantially cylindrical outer surface and a circular central bore having a longitudinal axis;

e. a second cruciform-shaped strut extending from said outer surface of said second pivot support and connecting said second pivot support to said outer surface of said cental body at a second location, said second location being spaced 180 degrees from said first location;

f. a cross member support having a substantially cylindrical outer surface and a circular central bore having a longitudinal axis;

g. a third cruciform-shaped strut extending from said outer surface of said cross member support and connecting said cross member support to said outer surface of said central body at a third location positioned midway between said first location and said second location;

h. said first, second and third struts being positioned at the same level on said central body;

i. said first strut and said second strut being equal in length, said first pivot support and said second pivot support being the same size, and said first strut being aligned with said second strut;

j. said first strut and said second strut each including a stop for preventing excessive rotational movement of horizontal stage bracing and for assisting in providing proper alignment of pivoted stage support members, said stops extending in the direction opposite to the direction in which said third strut extends from said outer surface of said central body;

k. said longitudinal axes of said circular central bores of said central body and said first and second pivot supports being parallel to each other and lying in the same plane;

l. said longitudinal axis of said circular central bore of said cross member support extending transverse to said longitudinal axes of said circular central bores of said central body and said first and second pivot supports and lying in a plane parallel to said plane containing said longitudinal axes of said circular central bores of said central body and said first and second pivot supports; and, m. said central body having two holes extending therethrough from said outer surface of said central body to said circular central bore of said central body, said two holes being spaced 180 degrees apart and being in alignment with each other.

* * * * *